United States Patent [19]

Ricke

[11] 4,418,900

[45] Dec. 6, 1983

[54] CORPSE POSITIONING SYSTEM

[76] Inventor: Theodore D. Ricke, 710 E. 4th, Hoisington, Kans. 67544

[21] Appl. No.: 240,217

[22] Filed: Mar. 3, 1981

[51] Int. Cl.[3] ..... A61G 13/00

[52] U.S. Cl. ..... 269/45; 269/88; 269/95; 269/328; 269/901

[58] Field of Search ..... 269/45, 901, 88, 95, 269/289 R, 309, 327, 328; 5/434, 437, 443, 431; 27/1, 12–13; 46/25, 28

[56] References Cited

U.S. PATENT DOCUMENTS

| | | | |
|---|---|---|---|
| 1,973,240 | 9/1934 | Werness et al. | 27/13 |
| 1,976,664 | 10/1934 | Gantt | 46/25 |
| 2,614,558 | 10/1952 | Lovell | 269/328 |
| 2,923,551 | 2/1960 | Pope | 46/25 |
| 3,234,623 | 2/1966 | Rector | 269/328 |
| 3,558,138 | 1/1971 | Lemelson | 46/25 |
| 3,701,214 | 10/1972 | Sakamoto | 46/25 |
| 3,799,534 | 3/1974 | Coles | 27/13 |
| 4,035,977 | 7/1977 | Fischer | 46/25 |
| 4,256,296 | 3/1981 | Scheinert | 269/45 |
| 4,259,757 | 4/1981 | Watson | 5/434 |

FOREIGN PATENT DOCUMENTS

| | | | |
|---|---|---|---|
| 56294 | 9/1952 | France | 46/25 |

*Primary Examiner*—Robert C. Watson

*Attorney, Agent, or Firm*—Schmidt, Johnson, Hovey & Williams

[57] ABSTRACT

A system for positioning a corpse upon an embalming table and providing sufficient support for the corpse so that it may be embalmed and thereby retained in the desired position, the system including a plurality of polygonal blocks of varying configurations, with at least one tongue or groove presented by each of said blocks whereby the blocks may be interlocked in desired and suitable arrangements to support various portions of the corpse in the desired position upon the table for embalming. There is provided a pair of first blocks, identical in configuration, in the form of a polygonal body having spaced indented areas on one surface thereof; a pair of second blocks, identical in configuration and in the form of a polygonal body having an arcuate portion in one surface thereof; a pair of third blocks, identical in configuration and in the form of a polygonal body having a tapered extension and a concavity on one surface thereof; a block in the form of an elongated bar for retention on the table with means on the bar for engaging the table and a tongue on the bar for mating with the grooves of other said blocks; and a block in the form of a polygonal rail having a tongue on one surface thereof, the rail being supportable by an arrangement of blocks to elevate an extremity of the corpse. When used in conjunction with an embalming table the interlocking blocks will allow a mortician to obtain correct and proper positioning of any corpse for embalming purposes providing a stable retaining and positioning means for the trunk and all body extremeties.

4 Claims, 9 Drawing Figures

CORPSE POSITIONING SYSTEM

BACKGROUND OF THE INVENTION

1. Field of the Invention

This invention relates to means for positioning a corpse upon an embalming table whereby the corpse will be retained in the desired position during the embalming procedure and whereby the corpse will be embalmed in said position and thereby retain such position.

2. Background of the Invention

While various means have been utilized in the past to position a corpse upon an embalming table and retain the corpse in a desired position during the embalming procedure, such means have heretofore been in the form of individual straps, blocks, bars, rails or the like which have not been coordinated to define a specific system for positioning the corpse but have merely been used in individual instances to retain a portion of the corpse; such as for instance to position the arms of the corpse in the desired folded position or to raise the head of the corpse during embalming procedures.

SUMMARY OF THE INVENTION

The present invention is in the nature of a system for positioning a corpse upon an embalming table, the system consisting of plurality of polygonal blocks of varying configurations, all of the blocks except one form presenting at least one corpse engaging surface, the blocks being provided with tongues and grooves whereby the blocks may be interlocked in multiple different arrangements to thereby be utilized to support different portions of the corpse in a desired position. Specifically, five different forms of blocks are provided, there being a pair of first blocks, each of the pair of first blocks having spaced indented areas on one surface thereof; a pair of second blocks each having an arcuate portion in one surface thereof; a pair of third blocks each having a tapered extension and a concavity on one surface thereof; a block in the form of an elongated bar having feet thereon for engaging the embalming table and a tongue for engagement with grooves on other of the blocks; and a block in the form of a polygonal rail having a tongue on one surface thereof for retention by a series of the other blocks in an elevated, generally horizontal position for supporting an extremity of the corpse.

Thus, a universal system is provided by the blocks which will be preferably fabricated from a polyvinyl chloride material whereby they are sanitary and readily washable to permit the re-use thereof.

An important feature is the interchangeability of the blocks to allow a mortician utilizing the same a multitude of positioning alternatives when supporting the corpse upon the embalming table. When suitable arrangements of the blocks are made up and utilized, a stable foundation and supporting means is provided for the trunk of the corpse and all body extremities of the corpse.

DESCRIPTION OF THE PREFERRED EMBODIMENT

Figures 1, 2, 3, 4, 5, 6:
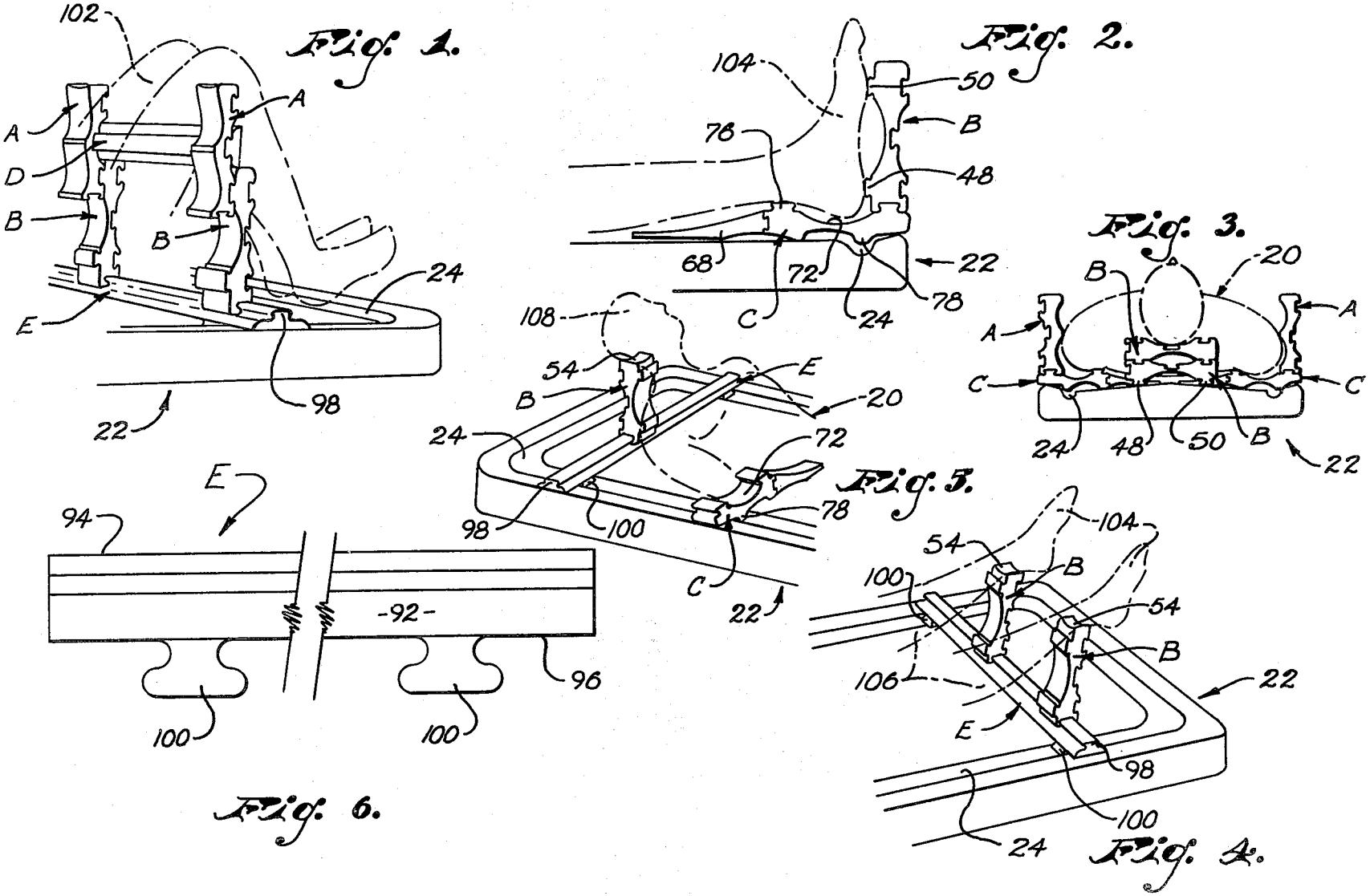
FIG. 1 is a fragmentary perspective view showing an arrangement of the blocks to elevate the knees of the corpse.
FIG. 2 is a fragmentary side elevational view showing an arrangement of the blocks to retain the feet of the corpse in a generally vertical position.
FIG. 3 is an end elevational view showing arrangements of the blocks to support the head, arms and upper body of the corpse.
FIG. 4 is a fragmentary perspective view showing an arrangement of the blocks, in conjunction with the embalming table to elevate the feet of the corpse.
FIG. 5 is a fragmentary perspective view showing an arrangement of the blocks utilized to support and retain the trunk of the corpse and also to position and maintain the head of the corpse in an elevated condition.
FIG. 6 is a fragmentary elevational view of the block in the form of an elongated bar used to span the embalming table.

The system for positioning a corpse upon an embalming table consists of a group of blocks of various configurations, there being a total of eight blocks comprising the system.

Thus, there is provided a pair of first blocks A; a pair of second blocks B; a pair of third blocks C; a block in the form of a rail D; and a block in the form of an elongated bar E.

Each of the blocks A–D has a corpse engaging surface presented thereby as will hereinafter be explained in more detail; and each of the blocks A–E is provided with either a tongue or a groove whereby the series or group of blocks A–E may be interlocked in various arrangements to support different portions of the corpse as shown for example in FIGS. 1–5 of the drawing.

Each of the blocks A–E is preferably fabricated from a polyvinyl chloride material for sanitary reasons and whereby the blocks may be easily and economically cleaned for subsequent reuse. It is contemplated that a series or group of blocks would be sufficient to enable a mortician to support and position a corpse upon an embalming table to thereby place the corpse in the desired position for embalming, which position the corpse retains after being embalmed.

To this end, the blocks A–E are intended for supporting the head, trunk and extremities of a corpse 20 upon an embalming table 22 which table 22 is conventional in nature, is fabricated from fiberglass or metal and is provided with a circumscribing trough 24 for drainage purposes.

Figures 7, 8, 9, 10:
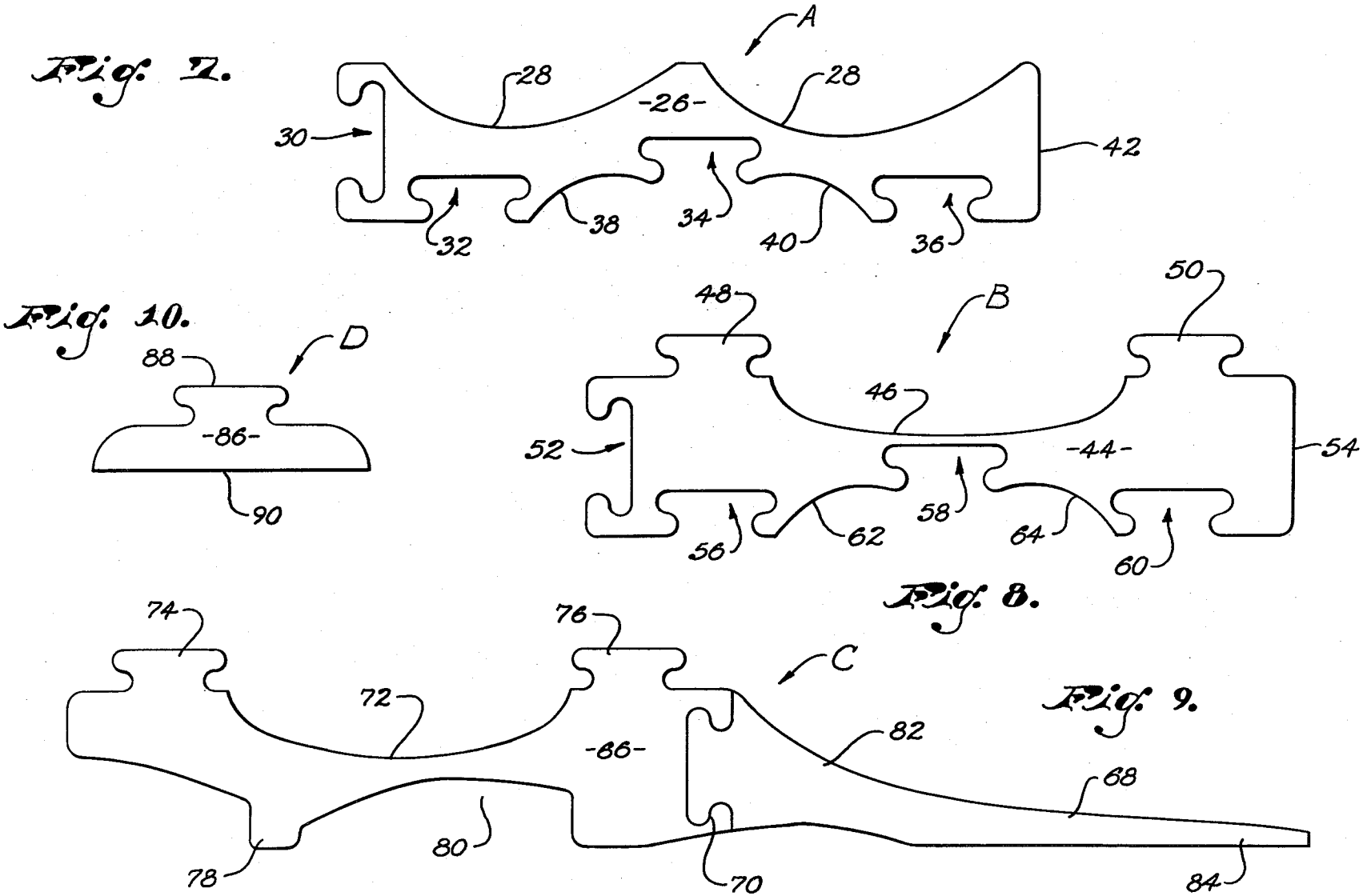
FIG. 7 is a side elevational view of one of the pair of first blocks.
FIG. 8 is a side elevational view of one of the pair of second blocks.
FIG. 9 is a side elevational view of one of the pair of third blocks.
FIG. 10 is an end elevational view of the block in the form of a rail.

The first blocks A are each identical in construction, one of said blocks being shown in FIG. 7 of the drawing, in elevation. Block A is in the form of polygonal body 26, the body having spaced, indented areas 28 on one surface thereof, a groove 30 in one end thereof, and three, spaced grooves 32, 34 and 36 formed in the surface thereof opposite to the surface in which the indented areas 28 are formed. Block A is further provided with a pair of spaced rounded areas 38 and 40, on said opposite surface, the rounded area 38 extending essentially from groove 32 to groove 34 and the rounded area 40 extending essentially from groove 34 to groove 36, all as illustrated in FIG. 7. The end of body 26 of block A opposite to that presenting groove 30 is flat as at 42.

The second pair of blocks B are likewise identical in configuration, one of said blocks B being shown in elevation in FIG. 8 of the drawing. The block B presents a polygonal body 44 having an arcuate portion 46 in one surface thereof, there being tongues 48 and 50 on each side of said arcuate portion 46. One end of body 44 is provided with a groove 52 and the other, opposite end is provided with a concave notch 54 best shown in FIGS. 4 and 5 of the drawing. Block B further includes, on the surface thereof opposite to that presenting arcuate portion 46 and tongues 48 and 50, three grooves 56, 58 and 60, there being curved stretches 62 and 64 presented by said surface of the body 44, the curved stretch 62 extending between groove 56 and groove 58 and the curved stretch 64 extending between groove 58 and groove 60.

The third blocks C are likewise identical in configuration, a pair of said blocks C being provided, as part of the system, one of said blocks being shown in elevation in FIG. 9 of the drawing.

Specifically block C is in the form of a polygonal body 66 having a tapered extension 68, which extension 68 may be formed as an integral part of the body 66 or, for molding purposes, may be formed as a separate piece and then interlocked with body 66 as by a tongue and groove assembly 70. It is intended that block C be retained and utilized as a single unitary block, the provision of tongue and groove assembly 70 being only necessitated when it is necessary, because of size limitations of a mold, to fabricate the block C initially into sections.

Block C is provided with a concavity 72 in one surface thereof, there being tongues 74 and 76 on each side of said concavity. A projection 78 is formed on the surface of body 66 opposite to that presenting concavity 72 and a cutout area 80 is likewise formed on said opposite surface. The tapered extension 68 is provided with a base portion 82 and a tip portion 84.

The block D is illustrated in FIG. 10 of the drawing and is in the form of an elongated rail having a body 86, the body having a tongue 88 formed on one surface thereof for mating with grooves of other blocks, the tongue extending essentially the full length of the body 86. The opposite surface of body 86 of block D is flat, being designated as 90.

The block E is in the form of an elongated bar having a body 92, the body presenting an upper surface 94 and a lower surface 96. Upper surface 94 has a tongue 98 formed thereon, the tongue 98 extending the full length of body 92 as shown for instance in FIGS. 4 and 5 of the drawing. The lower surface of 96 of body 92 of block E has a pair of spaced feet 100 formed thereon, as illustrated in FIGS. 5 and 6 for instance, the feet being adapted to seat within the trough 24 whereby to retain block E in spanning relationship to the embalming table 22, as illustrated in FIGS. 1, 4 and 5 whereby said block E may be utilized to support arrangements of other of the blocks to in turn support the head or extremities of the corpse 20.

It should be noted that all of the tongues hereinabove referred to and which are found on each of the blocks A–E are of the same cross-sectional configuration as the grooves hereinabove referred to, which grooves are found on blocks A, B and C whereby the respective tongues and grooves may be mated and interlocked whereby to join two or more blocks together in an arrangement, which arrangement may be readily determined by the user of the group of blocks A–E as is necessary to support the head, trunk or extremities of the corpse 20 in desired positions upon the embalming table. While the tongues and grooves are illustrated as being generally T-shaped in cross-sectional configuration, it will be appreciated that they might well assume any cross-sectional configuration and still permit interlocking arrangements of a group of blocks.

In utilizing the blocks A–E, the tongues and grooves provided thereon are utilized, as illustrated, to form various arrangements by which portions of the corpse may be suitably supported on the embalming table 22, for the embalming procedure, the supported position of the corpse being retained after embalming has been completed.

FIGS. 1–5 of the drawing are illustrative of various, typical arrangements of the blocks A–E.

Thus, for instance, if it is desired to shorten the overall length of the corpse, as in the case of an unusually tall individual, the legs 102 may be bent as shown in FIG. 1 and supported in such a position, by the arrangement illustrated, which support will also prevent the knees of the corpse from falling to either side.

The arrangement illustrated in FIG. 1 is created by initially placing block E in spanning relationship to the table 22 with the feet 100 received in spaced, opposed stretches of the trough 24, whereby to position the tongue 98 in upwardly facing generally horizontal relationship with respect to the table 22. Once block E has been so positioned, the pair of blocks B may be positioned as illustrated by engaging grooves 52 on the ends of blocks B with tongue 98 to thereby position block B in vertical relationship with respect to block E and the table 22.

The pair of blocks A may then be engaged and interlocked with the two upstanding blocks B by engaging groove 32 of block A with tongue 50 of block B whereby to lock blocks A in vertical relationship to corresponding blocks B.

Once blocks A and B have been assembled as described above, the block D may be inserted within grooves 34 of the spaced blocks A, by placing tongue 88 of block D in said groove whereby to position the block D, which is in the form of a rail in an elevated horizontal position for supporting the legs and knees of the corpse 20. It will be noted that, in creating such an arrangement, both of the pair of blocks B and both of the pair of blocks A are utilized, together with blocks D and E.

In the use of the system illustrated in FIG. 2 of the drawing, an arrangement is provided to shorten the overall length of the corpse by positioning the feet in a substantially vertical position and preventing the feet of the corpse from inclining to about a 45° angle.

Such a supporting arrangement also slightly elevates the lower legs and feet of the corpse and is created by utilization of blocks C, the tapered extension 68 of block C being inserted under the lower leg of the corpse with the tongue 76 providing support beneath the ankle of the corpse, the heel of the foot of the corpse being generally received within concavity 72 of block C, it being noted that the projection 78 is received within the trough whereby to prevent longitudinal movement of the block C when it is positioned as described above and as illustrated in FIG. 2.

To support the foot 104 in a vertical position, one of the blocks B is interlocked with block C as by engaging tongue 74 of block C with the groove 52 of block B to thereby cause the tongues 48 and 50 of block B to bear against the bottom of the foot 104 of the corpse and thereby retain the same in the desired position. It will be appreciated that, in order to support both feet 104 of the corpse, an arrangement such as described above would also be utilized for the other foot and would include the other block C and the other block B.

FIG. 3 of the drawing illustrates an arrangement of the blocks which may be utilized to elevate the head of the corpse and to also retain the upper arms and shoulder areas of the corpse to thereby prevent movement from the table and to position the corpse in the desired position.

Such arrangement is initially created by placing the two blocks C in opposed, aligned relationship as illustrated, the concavities of the respective blocks underlying the arms of the corpse, it being noted that the concavity is shaped in such a manner as to embrace the arms.

Then, and in order to support the head in an elevated position, a pair of blocks B are stacked, as illustrated, the lowermost of said blocks resting upon the table through tongues 48 and 50, the uppermost block B being connected to the lowermost block by engagement of tongues 48 and 50 with grooves 56 and 60, respectively, the back of the head of the corpse being received within the curved stretches 62,64 of the block B.

To retain the arms in the desired position, the pair of blocks A may be utilized as illustrated, the blocks A being interlocked with tongues 74 of corresponding blocks C, by engagement with the corresponding grooves of blocks A, whereby to position the blocks A in generally vertical relationship and with one of the indented areas, such as 28, for instance, being in embracing relationship with the upper arm portion of the corpse 20. The arrangement illustrated in FIG. 3 utilizes both of the pair of blocks A, both of the pair of blocks B and both of the pair of blocks C.

The arrangement illustrated in FIG. 4 of the drawing is used to support the feet 104 of the corpse and the lower leg portions 106 in an elevated condition, as illustrated.

Said arrangement is created by initially placing block E in spanning relationship to the embalming table 22, with the feet 100 of the body 92 being received within the trough 24 as illustrated. Once this has been accomplished, the pair of blocks B are interlocked with the tongue 98 of block E as by mating the groove 52 on each of said blocks B with the tongue 98 whereby to position the blocks B in vertical relationship to the block E and table 22. Inasmuch as the ends of each block B opposite to that presenting grooves 52 are formed to present a concave notch, the lower leg portion of the corpse may be received within said notches 54 whereby to elevate the feet and lower legs in spaced relationship, all as illustrated in FIG. 4 of the drawing. Such elevation is sometimes necessary when circulation problems are encountered.

In the arrangement shown in FIG. 5 of the drawing, a pair of the blocks C are utilized, together with block E and one of the blocks B.

Initially and in order to support the trunk of the corpse and to retain the corpse on the table 22, a block C is inserted beneath the corpse on each side thereof and the projection 78 is seated in trough 24 whereby to prevent outward movement of either of the blocks C from each side of the corpse 20. Once the blocks C have been so positioned, the elbow of the corpse may be placed in concavity 72 and the hands and lower arms folded over the chest or stomach of the corpse 20 in the desired embalming position.

In order to elevate the head 108 of the corpse 20 and utilizing an arrangement other than that illustrated in FIG. 3 of the drawing, the block E is placed in spanning relationship to the table 22, as hereinabove described, and then a block B is interlocked with the block E by engaging the tongue 98 of block E with groove 52 of block B whereby to place the concave notch 54 on the end of block B beneath the head 108 of the corpse to thereby retain the same in an elevated condition.

The various arrangements hereinabove described are merely typical of those which may be created through utilization of the blocks which make up the corpse positioning system disclosed herein. It will be readily appreciated that, by virtue of the provision of interlocking tongues and grooves on the blocks, they may be interlocked in many different arrangements to appropriately retain and position a corpse upon an embalming table for embalming purposes.

I claim:

1. A corpse positioning system including:

a pair of first blocks, identical in configuration;

said pair of first blocks each being in the form of a polygonal body having spaced, identical areas on one surface thereof and grooves in the surface thereof opposite to said indented areas;

a pair of second blocks, identical in configuration;

a pair of third blocks, identical in configuration;

an embalming table for supporting the corpse in a generally prone position; and means on the blocks for interlocking the first, second and third blocks in various arrangements to support and retain the corpse in the proper position on the embalming table for embalming purposes.

2. A corpse positioning system including:

a pair of first blocks, identical in configuration;

a pair of second blocks, identical in configuration;

said pair of second blocks each being in the form of a polygonal body having an arcuate portion in one surface thereof, a tongue on each side of said arcuate portion, a concave notch in one end thereof, a groove in the other end thereof and grooves in the surface thereof opposite to said arcuate portion;

a pair of third blocks, identical in configuration;

an embalming table for supporting the corpse in a generally prone position; and means on the blocks for interlocking the first, second and third blocks in various arrangements to support and retain the corpse in the proper position on the embalming table for embalming purposes.

3. A corpse positioning system including:

a pair of first blocks, identical in configuration;

a pair of second blocks, identical in configuration;

a pair of third blocks, identical in configuration;

said pair of third blocks each being in the form of a polygonal body having a tapered extension, a concavity on one surface thereof, a tongue on each side of the concavity and a projection on the surface thereof opposite to said concavity;

an embalming table for supporting the corpse in a generally prone position; and means on the blocks for interlocking the first, second and third blocks in various arrangements to support and retain the corpse in the proper position on the embalming table for embalming purposes.

4. A corpse positioning system including:

a pair of first blocks, identical in configuration;

a pair of second blocks, identical in configuration;

a pair of third blocks, identical in configuration;

an embalming table for supporting the corpse in a generally prone position;

a block in the form of a polygonal bar for spanning the embalming table, said bar having feet on the lower surface thereof for engaging the table to retain the bar and a tongue on the upper surface thereof for mating with the grooves of selected first or second blocks to create an arrangement of blocks for supporting extremities of the corpse in an elevated position;

a block in the form of a polygonal rail having a tongue on one surface thereof, the opposed surface being flat, said rail being supportable by an arrangement of said blocks to retain the rail in an elevated, horizontal position for supporting the legs of the corpse; and means on the blocks for interlocking the first, second and third blocks in various arrangements to support and retain the corpse on the embalming table for embalming purposes, said interlocking means being in the form of mating tongues and grooves formed in said first, second and third blocks.

* * * * *